US011913233B2

(12) United States Patent
Kortmeyer et al.

(10) Patent No.: US 11,913,233 B2
(45) Date of Patent: Feb. 27, 2024

(54) ADHERING SINGLE PLY MEMBRANE TO A ROOF DECK WITH A HOT MELT OR PRESSURE SENSITIVE ADHESIVE APPLIED TO A RELEASE LINER OR TRANSFER FILM

(71) Applicant: JOHNS MANVILLE, Denver, CO (US)

(72) Inventors: Jordan Kortmeyer, Parker, CO (US); Jonas Houchin, Centennial, CO (US)

(73) Assignee: Johns Manville, Denver, CO (US)

( * ) Notice: Subject to any disclaimer, the term of this patent is extended or adjusted under 35 U.S.C. 154(b) by 88 days.

(21) Appl. No.: 17/578,667

(22) Filed: Jan. 19, 2022

(65) Prior Publication Data

US 2023/0228093 A1 Jul. 20, 2023

(51) Int. Cl.

| | |
|---|---|
| ***E04D 15/06*** | (2006.01) |
| ***E04D 1/34*** | (2006.01) |
| ***E04D 5/14*** | (2006.01) |

(52) U.S. Cl.

CPC ..... *E04D 15/06* (2013.01); *E04D 1/34* (2013.01); *E04D 5/148* (2013.01); *E04D 2001/3435* (2013.01)

(58) Field of Classification Search

CPC ..... E04D 15/06; E04D 1/34; E04D 5/148; E04D 2001/3435

See application file for complete search history.

(56) References Cited

U.S. PATENT DOCUMENTS

| | | | | |
|---|---|---|---|---|
| 4,736,552 | A * | 4/1988 | Ward | E04D 13/1618 52/410 |
| 6,742,313 | B2 * | 6/2004 | Ritland | B32B 27/02 52/746.1 |
| 6,962,738 | B2 * | 11/2005 | Swann | E04D 5/148 428/491 |
| 7,618,685 | B2 * | 11/2009 | Tanaka | C09D 183/06 427/515 |
| 8,778,131 | B2 * | 7/2014 | Demmig | C09J 175/04 156/331.4 |
| 9,157,238 | B2 * | 10/2015 | Linnenbrink | B32B 7/12 |
| 11,441,317 | B1 * | 9/2022 | Gory | E04D 15/06 |
| 11,459,760 | B2 * | 10/2022 | Gish | B32B 29/02 |
| 2009/0258176 | A1 * | 10/2009 | Muta | C09J 133/02 428/41.5 |
| 2010/0032076 | A1 * | 2/2010 | Turney | E04D 12/002 156/574 |
| 2017/0362478 | A1 * | 12/2017 | Blömker | C08G 18/3206 |

* cited by examiner

*Primary Examiner* — Adriana Figueroa

(74) *Attorney, Agent, or Firm* — Robert D. Touslee

(57) ABSTRACT

A method for applying a roofing membrane may include unrolling an adhesive material onto a roofing board to adhere a bottom surface of the adhesive material to the roofing board. The method may include removing a release liner from the adhesive material to expose a top surface of the adhesive material. The method may include applying a roofing membrane to the exposed top surface of the adhesive material to adhere the roofing membrane to the roofing board.

13 Claims, 5 Drawing Sheets

ADHERING SINGLE PLY MEMBRANE TO A ROOF DECK WITH A HOT MELT OR PRESSURE SENSITIVE ADHESIVE APPLIED TO A RELEASE LINER OR TRANSFER FILM

BACKGROUND

Roofing membranes are used to prevent leaks in a roofing structure, to provide aesthetic appeal, and/or to impart heat reflection and/or absorption properties on a roofing structure. Oftentimes, these membranes are secured to a roofing substrate using an adhesive. Conventionally, this adhesive is applied in the field during installation of the membrane, such as by spraying and/or rolling liquid adhesive onto a roofing substrate prior to laying down the roofing membrane. However, such manual application results in inconsistent coating thickness. Additionally, various environmental conditions (humidity, precipitation, temperature, wind, etc.) may be unpredictable and may affect the flash-off time of the adhesive, which may limit the ability of the adhesive to properly adhere the roofing membrane to the roofing structure. Therefore, improvements in the installation of roofing membranes are desired.

SUMMARY

Embodiments of the present invention are directed to rolls of adhesive for adhering roofing membranes and/or other materials to a substrate. The adhesive rolls include a partially or fully cured adhesive that provide a consistent level of tack. The adhesive rolls may have a consistent thickness across the area of the adhesive roll. A release liner may be positioned on one or both major surfaces of the adhesive roll to protect the adhesive until installation. This may enable installers to quickly lay out an even layer of adhesive when installing a membrane, without needing to work with liquid adhesives or worrying about environmental factors. The adhesive rolls may shorten the installation time, while providing a more uniform adhesive layer to secure a membrane to a substrate.

In one embodiment, a method for applying a roofing membrane is provided. The method may include unrolling an adhesive material onto a roofing board to adhere a bottom surface of the adhesive material to the roofing board. The method may include removing a release liner from the adhesive material to expose a top surface of the adhesive material. The method may include applying a roofing membrane to the exposed top surface of the adhesive material to adhere the roofing membrane to the roofing board.

In some embodiments, applying the roofing membrane may include unrolling the roofing membrane onto the exposed top surface of the adhesive material. The method may include applying pressure to a top surface of the roofing membrane once applied to the top surface of the adhesive material. Applying pressure to the top surface of the roofing membrane may include rolling the roofing membrane with a weighted roller. The adhesive may include one or more selected from a group consisting of a hot melt adhesive, water-based adhesive, a pressure sensitive adhesive, a butyl rubber-based adhesive, and a UV curable adhesive. Unrolling the adhesive material, removing the release liner, and applying the roofing membrane may be performed using a roofing membrane installation apparatus. The release liner may include a UV protective material.

In some embodiments, a roofing membrane installation apparatus may be provided. The apparatus may include a frame having at least one handle. The apparatus may include an adhesive spool rotatably coupled with the frame. The adhesive spool may be configured to apply a layer of adhesive material to a substrate as the frame is advanced in a forward direction. The apparatus may include a release liner take-up reel rotatably coupled with the frame. The release liner take-up reel may be configured to collect a release liner that is removed from a top surface of the adhesive material as the frame is advanced in the forward direction. The apparatus may include a roofing membrane spool rotatably coupled with the frame. The roofing membrane spool may be configured to apply a roofing material to a top surface of the adhesive material as the frame is advanced in the forward direction.

In some embodiments, the release liner take-up reel may be positioned rearward and above the adhesive spool. A thickness of the adhesive material may be uniform to within 95% across a surface of the adhesive material. The apparatus may include a front weighted roller positioned rearward of and below the adhesive spool. The front weighted roller may be configured to apply pressure to the release liner and the adhesive material prior to the release liner being collected by the release liner take-up reel. The apparatus may include a rear weighted roller positioned rearward of and below the roofing membrane spool. The rear weighted roller may be configured to apply pressure to the roofing membrane after being applied to the top surface of the adhesive material. Each of the front weighted roller and the rear weighted roller may include a weight per linear inch of at least about 5 pounds per linear inch. The roofing membrane spool may be positioned rearward of the adhesive spool and the release liner take-up reel. Each of the adhesive spool, the release liner take-up reel, and the roofing membrane spool may be coupled with the frame using at least one of a plurality of mounting hubs.

Some embodiments of the present invention may be directed to a roofing kit. The roofing kit may include a roll of adhesive material. An outer surface of the adhesive material may include a release liner. The adhesive material may have a thickness of between about 1 mil to 100 mils. The release liner may have a thickness of between about 1 mil and 15 mils. The kits may include a roll of roofing membrane. The roofing membrane may include one or more of TPO, EPDM, and PVC.

In some embodiments, the adhesive may include one or more selected from a group consisting of a hot melt adhesive, water-based adhesive, a pressure sensitive adhesive, a butyl rubber-based adhesive, and a UV curable adhesive. The release liner may be biodegradable. The release liner may include a UV protective material. A thickness of the adhesive material may be uniform to within 95% across a surface of the adhesive material. The adhesive material may be at least partially cured.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to pre-formed rolls of adhesive material, which may be used to secure a membrane, such as a roofing membrane, to a substrate, such as a roofing structure. The adhesive material in the rolls is partially or fully cured such that the adhesive material is sufficiently tacky at the time of installation, while being sufficiently solid such that the adhesive will not run or flow. The solid nature of the adhesive may not only improve the speed and consistency of securing membranes to roofing structures, but may also enable the adhesive material to be used to secure membranes (or other materials) to vertical surfaces without the adhesive material flowing downward due to gravity. While discussed primarily in the context of roofing membranes, it will be appreciated that the adhesive rolls described herein are no so limited, and may be utilized in numerous other applications in which two materials need to be adhered to one another.

Figure 1:
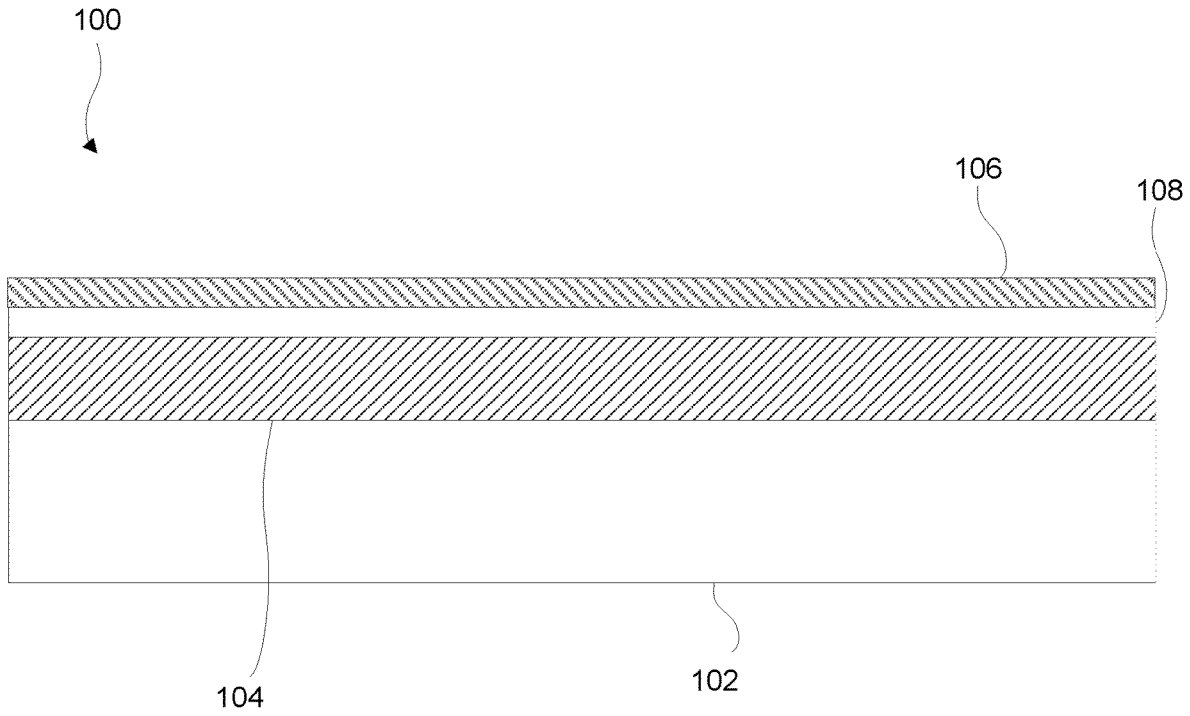
FIG. 1 illustrates a roofing structure according to embodiments of the present invention.

Turning now to FIG. 1, one embodiment of a roof structure 100 is illustrated. Roof structure 100 may include a roof deck 102, which may be formed from various materials such as, but not limited to, steel, concrete, cement and/or wood. Roof deck 102 may serve as a primary substrate on which various insulation and/or weatherproofing layers are supported. Roof structure 100 may include a number of roofing cover boards 104, which may protect the roof deck 102 and/or provide insulation to the roof structure 100. The roofing cover boards 104 may include polyisocyanurate, oriented strand board, gypsum, and/or other roofing boards. Additional structural and/or insulation layers may be included in some embodiments. A roofing membrane 106 may be positioned atop roof structure, oftentimes above the cover boards 104 and/or other insulation layer, and may be configured to prevent leaks in the roofing structure 100 and/or to provide aesthetic appeal. Typically, the roofing membrane 106 may be in the form of a single ply membrane. The term "single-ply" may be used to describe a roof structure having a single application of a roofing membrane 106, but the roofing membrane 106 itself may include multiple layers. For example, the roofing membrane 106 may include polymer layers, reinforcing layers, adhesive layers, coatings, a fleece layer, and the like. It will be appreciated that in some embodiments, multiple layers of roofing membrane 106 may be applied to a single roof structure.

Oftentimes, the roofing membrane 106 may be provided as a roll of flat, flexible membrane that may be rolled out on top of the roof structure. For example, a single ply roofing membrane 106 may be supplied in any workable size (such as, but not limited to, rolls of 10 feet wide or more and containing 100 linear feet or more of roofing membrane 106). Oftentimes, the roof structure may be too large to be covered by a single piece of roofing membrane 106. In such instances, multiple pieces of roofing membrane 106 may be overlapped and joined at the seams using a waterproof joining method. For example, seams of adjacent pieces of roofing membrane 106 may be joined by priming and/or preparing edges of the roofing membranes 106 and then applying a tape to the primed and/or prepared edges, using heat welding and/or using another form of adhesive bonding. In priming or preparing the edges, the installer must wait for the primer material to flash before applying the adhesive. Improper application of the primer and/or adhesive may result in an improper bond, which may create immediate and/or long term roofing problems, such as leakage. Examples of using and installing single ply roofing membranes 106 may be found in U.S. Patent Publication No. 2016/0362894, entitled "Sheet Roofing with Pre-Taped Seams and Tape Therefor" and filed Aug. 25, 2016, the entire contents of which is hereby incorporated by reference for all purposes.

In some embodiments, roofing membrane 106 may include one or more polymeric membranes and/or other waterproofing layer. For example, a polymeric membrane may form the outer layer of the roof once fully installed, and may help prevent leaks in the roofing structure and provides aesthetic appeal to the finished roof. For example, the waterproofing layer often provides a uniform outer surface that provides an aesthetically pleasing finished appearance to the roof. Polymeric membrane may have a white exterior, but may be made in various other colors or shades, such as grey, tan, black, and the like. White polymeric membranes are often used to provide a pleasing appeal to the building and/or to reflect radiation and thereby minimize heat island effects. In other embodiments, a black or other dark polymeric membrane may be provided. Such polymeric membranes absorb more radiant heat than white polymeric membranes. Additionally, in the winter, condensation evaporates quicker and snow and ice melt more rapidly on black roofs than white roofs.

In some embodiments, polymeric membranes may be formed of various synthetic rubber materials, modified bitumen, or thermoplastic materials. For example, roofing membrane 106 may commonly include thermoplastic polyolefin (TPO), polyvinyl chloride (PVC), ethylene propylene diene monomer (EPDM), chlorinated polyethylene (CPA), and/or modified bitumen, although some embodiments may use other thermoset and/or thermoplastic roofing membranes. In some embodiments, the polymeric membrane may include one or more polymers blended with one or more fillers. For example, in some embodiments the polymeric membranes may include some combination of the following materials: polypropylene, polyethylene, block copolymer polypropylene, rubber, plasticizers, fiberglass, carbon fiber, fire retardants, and the like. In another embodiment, a polymeric membranes may have a more pure polymer blend without or with very few fillers. For example, the polymeric membrane may include mainly polypropylene or polyethylene or some combination of these polymers with little to no fillers, although in some embodiments, these polymeric membranes may include some amount of a filler, such as a fire retardant. In some embodiments, the polymeric membrane may have a thickness of between about 500 μm to about 3 mm, however other thicknesses are possible in various embodiments.

The roofing membrane 106 may be secured to the roofing structure 100 using an adhesive 108. For example, adhesive 108 may be positioned between the cover boards 104 and the roofing membrane 106. The adhesive 108 may have a thickness of between about 1 mil and 100 mils, between about 2 mils and 50 mils, between about 3 mils and 40 mils, between about 4 mils and 30 mils, between about 5 mils and 20 mils, or between about 6 mils and 15 mils. The adhesive 108 may have a substantially uniform thickness across the entire surface area of the adhesive 108. For example, the adhesive may have a thickness that is uniform to within 95%, to within 96%, to within 97%, to within 98%, to within 99%, or more across a surface of the adhesive 108.

To help speed up and improve the consistency of the installation process, the adhesive may be supplied in an at least partially pre-cured state, with the adhesive having a consistent thickness across an entire surface area of the adhesive. For example, the adhesive may be formed into sheets of partially or fully cured adhesive, which may then be rolled up for storage and transport prior to being installed. Prior to installation, the adhesive may include a release liner that protects the adhesive material. During installation, the release liner may be removed to enable the adhesive and roofing membrane 106 to be quickly and easily installed. The adhesive material in the rolls is partially or fully cured such that the adhesive material is sufficiently tacky at the time of installation, while being sufficiently solid such that the adhesive will not run or flow.

Figure 2:
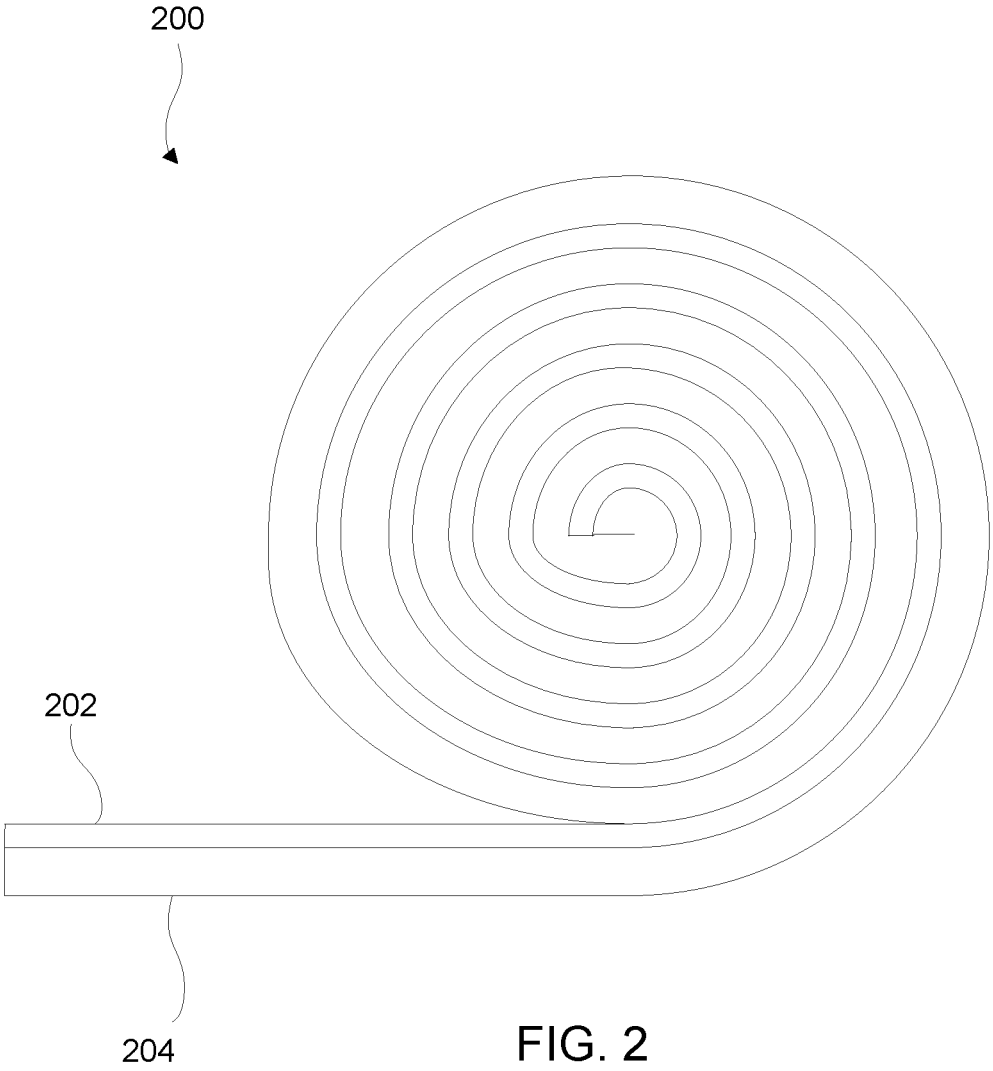
FIG. 2 illustrates a roll of adhesive material according to embodiments of the present invention.

FIG. 2 illustrates a roll 200 of an adhesive material 202 in accordance with the present invention. Adhesive material 202 may be used as adhesive 108 in some embodiments. For example, the roll 200 of adhesive material 202 may be unrolled atop a roofing substrate (such as cover boards and/or other insulation layer) and a roofing membrane may be applied on an exposed top surface of the adhesive material 202. The adhesive material 202 may be present in a partially and/or fully cured state, with any remaining curing being passively performed after installation, such as by exposing the adhesive material 202 to heat and/or UV light from the environment. Adhesive material 202 may include a hot melt adhesive, water-based adhesive, a pressure sensitive adhesive, a butyl rubber-based adhesive, a UV curable adhesive, and/or other adhesive. Oftentimes, the adhesive material 202 may include a high solids content (such as between about 5% and 20% by weight), which may help reduce flash off time during the manufacturing process.

In a particular embodiment, the adhesive material 202 may be a hot melt adhesive that includes between about 50% and 90% of a 100% cured acrylic high molecular weight hot melt adhesive with 0% to 20% rosin or terpene resin tackifier and 0% to 15% of curatives. The molecular weight of the resin may range be between about 100,000 MV/g/mol and 600,000 MV/g/rnol. Examples of acrylic resins that may be used include Acrynax 11588 and/or Acrynax 11891 from Franklin Adhesives and Polymers. Additional examples of suitable acrylic resins may include Vinnapas UW 25FS and/or Vinnapas B/500/40 VL from Wacker Chemie AG. Suitable tackifiers may include Dymerex or Foral AX-E from Eastman Rosin Products. In some embodiments, the adhesive material 202 may be a pressure sensitive adhesive that includes 50% to 75% styrene butadiene rubber, between 0% and 20% neoprene, between 5% and 15% of a tackifier, and between 0% and 15% of curatives.

When the adhesive material 202 is a UV curable adhesive, such as a UV curable acrylic adhesive, the adhesive material 202 may be fully cured during manufacturing and/or may be partially cured. In embodiments in which the UV curable adhesive is only partially cured, the UV curable adhesive may be fully cured after installation by exposure to a UV light source, such as a UV lamp and/or natural UV light (sunlight). The UV curable adhesive may have a thickness of less than about 4 mils, less than about 3.5 mils, less than about 3 mils, less than about 2.5 mils, less than about 2 mils, less than about 1.5 mils, less than about 1 mil, or less. The thickness of the UV curable adhesive may be particularly important when the UV curable adhesive is only partially cured during manufacture, as UV energy may only penetrate 1 to 2 mils into the UV curable adhesive. Thus, thinner UV curable adhesive layers may have better cross-linking density than thicker layers.

The UV curable adhesive may include between about may include between about 45% and 80% of a UV cross-linkable acrylic resin, between about 20% and 40% of a tackifier resin, and between about 0% and 15% of a photo-initiator and/or polymerizer. The high level of tackifier within the UV curable adhesive may increase the peel strength of the roofing membrane 106. Non-limiting examples of UV cross-linkable acrylic resins that may be used include acResin® A260 and acResin® A250 produced by BASF. Non-limiting examples of tackifier resins that may be used include Kraton SYLVALITE RE 80 HP Rosin Ester, Non-limiting examples of photo-initiators and/or polymerizers that may be used include benzophenone and bismaleimides.

The UV curable adhesive may have a glass transition temperature that is less than about less than about −20° C., less than about −25° C., less than about −30° C., or less. The low glass transition temperature enables the UV curable adhesive and roofing membrane 106 to remain tacky at low temperatures, such as temperatures as low as 15° F. The UV curable adhesive may exhibits a peel strength of at least 5 pounds per linear inch (PLI) when applied to conventional roofing materials, such as ISO, OSB, and gypsum roofing boards. For example, the peel strength of the UV curable adhesive may be between about 5 PLI and 15 PLI, between about 6 PLI and 12 PLI, between about 7 PLI and 9 PLI. Higher peel strengths may be achieved in some embodiments, Other adhesives, such as epoxy and urethane adhesives, may be used in some embodiments.

Adhesive material 202 may have a thickness of between about 1 mil and 100 mils, between about 2 mils and 50 mils, between about 3 mils and 40 mils, between about 4 mils and 30 mils, between about 5 mils and 20 mils, or between about 6 mils and 15 mils. The adhesive material 202 may have a substantially uniform thickness across the entire surface area of the roll 200. For example, the adhesive may have a thickness that is uniform to within 95%, to within 96%, to within 97%, to within 98%, to within 99%, or more across a surface of the roll 200.

The roll 200 may include a release liner 204 that may be provided on an external surface of the adhesive material 202. For example, the release liner 204 may be coupled with an exposed surface of the adhesive material 202 to protect the adhesive material 202 and to prevent the adhesive material 202 from adhering to any surfaces prior to removal of the release liner 204 during the installation process. The release liner 204 may have a thickness of between about 1 mil and 15 mils, between about 2 mils and 10 mils, or between about 3 mils and 5 mils, with thinner release liners generating less waste and enabling a diameter of the roll 200 to be reduced. The release liner 204 may be biodegradable and/or may include single and/or double-sided silicone-based release liners in some embodiments. In some embodiments, the release liner 204 may include a UV blocking material, such as Mylar and/or silicone-based release liners that include UV-absorbing chemicals. One example of a suitable release liner is Saint Gobain NORFILM. This may be particularly useful in embodiments in which the adhesive material 202 is a UV curable adhesive and is only partially cured during the manufacturing process, as the UV blocking material may prevent the UV curable adhesive from fully curing during storage and ensures that the full cure occurs only after the release liner 202 has been removed during and/or after the installation process. In some embodiments, both major surfaces of the adhesive material 202 may include a release liner.

Figure 3:
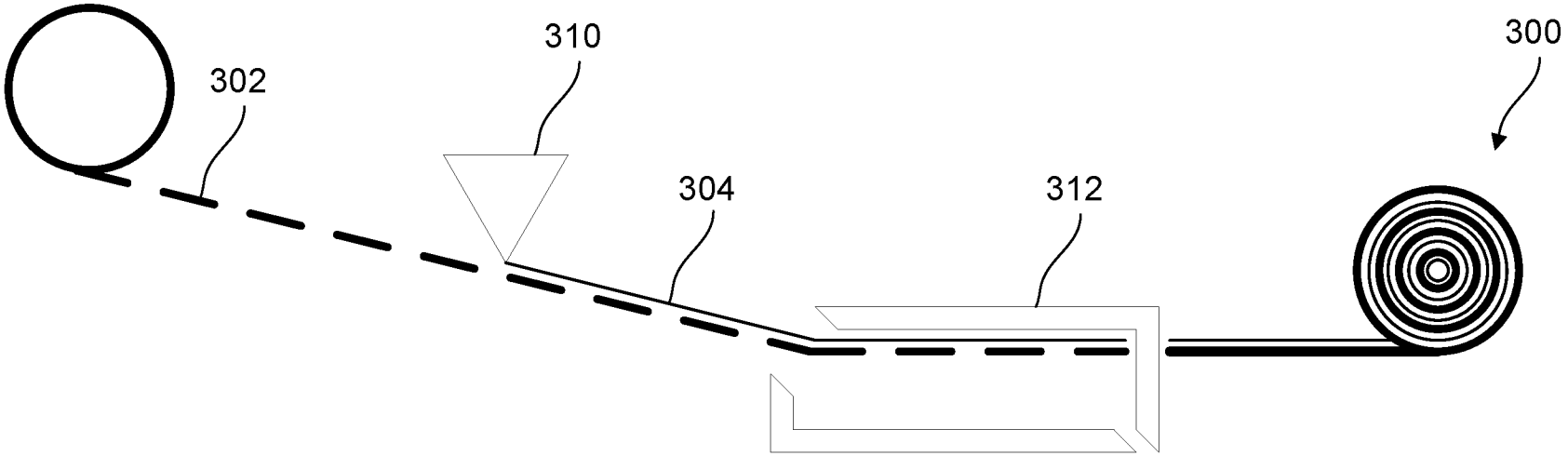
FIG. 3 illustrates a process of manufacturing a roll of adhesive material according to embodiments of the invention.

FIG. 3 illustrates one process of manufacturing a roll 300 of adhesive material, similar to roll 200. As illustrated, a release liner layer 302 may be provided. The release liner layer 302 may be similar to those described elsewhere herein, and may be passed under one or more adhesive applicators 310. Adhesive applicators 310 apply an adhesive material 304, which may be similar to the adhesive 108 and/or adhesive material 202 described elsewhere herein, to a major surface of the release liner layer 302. The adhesive material 304 may be applied by the adhesive applicators 310 using extrusion processes, transfer coating, die coating, spray coating, roll coating, and/or using other techniques to apply the adhesive material 304 to a major surface of the release liner layer 302. The adhesive material 304 may be applied at a thickness of between about 1 mil and 100 mils, between about 2 mils and 50 mils, between about 3 mils and 40 mils, between about 4 mils and 30 mils, between about 5 mils and 20 mils, or between about 6 mils and 15 mils. If the adhesive material 304 is a UV curable adhesive, the adhesive material 304 may often be applied at a thickness of less than about 8 mils. The adhesive material 304 may have a substantially uniform thickness across the entire surface area of the roll 300. For example, the adhesive may have a thickness that is uniform to within 95%, to within 96%, to within 97%, to within 98%, to within 99%, or more across a surface of the roll 300. In some embodiments, the adhesive material 304 may be applied using a single pass, while in other embodiments multiple passes may be used to apply the adhesive material 304 to a desired thickness. Pressure may be applied to the adhesive material 304 and release liner layer 302 to help bond the two materials. Once applied, the adhesive material 304 may be partially or fully cured. The curing may be active or passive. For example, in some embodiments, the adhesive material 304 (and release liner layer 302) may be passed through and/or under a heat source 312 (e.g., an infrared (IR) heater, a UV light source, an oven, microwave, and/or other heating source) to dry and/or cure the adhesive material 304. In some embodiments, adhesive material 304 may be chemically cured and/or dried. In some embodiments, the adhesive material 304 may be dried and/or cured by exposure to air, such as by passive exposure to air and/or circulating air from a fan and/or other airflow device. In other embodiments, additional drying and/or curing steps may be provided.

Upon curing of the adhesive material 304, the adhesive material 304 and release liner layer 302 may be cut to desired dimensions and/or be wound to form roll 300 for subsequent storage and/or shipment. For example, each roll 300 may, when unwound, have a width of between about 24 inches and 144 inches and a length that is specified by a customer and/or application. The final rolls 300 of adhesive material 304 may be installed immediately after manufacture and/or stored for later use. If stored, the rolls 300 may be maintained at temperatures of less than about 160° F., which may help prevent the adhesive materials from oxidizing.

Figure 4:
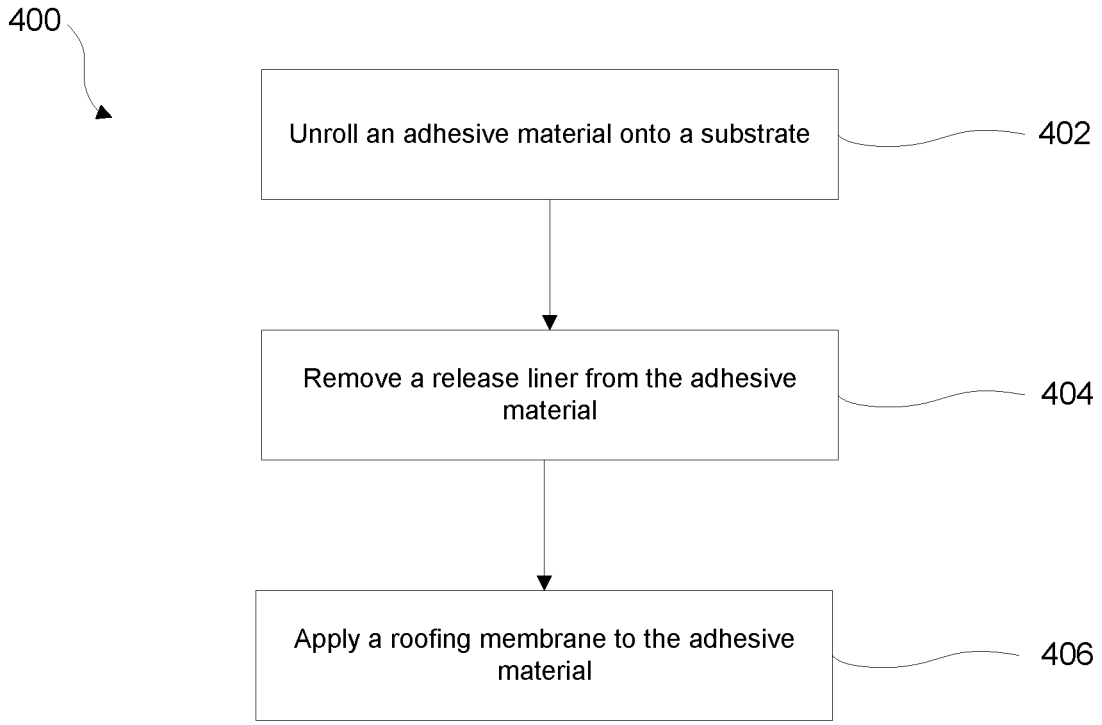
FIG. 4 illustrates a process of installing a roofing membrane according to embodiments of the invention.

FIG. 4 is a flowchart illustrating a process 400 for installing a roofing membrane, such as roofing membrane 106. Process 400 may begin at operation 402 by unrolling an adhesive material onto a substrate, such as a roofing board and/or other insulation layer to adhere a bottom surface of the adhesive material to the substrate. The adhesive material may be similar to those described above. For example, the adhesive material may include a hot melt adhesive, water-based adhesive, a pressure sensitive adhesive, a butyl rubber-based adhesive, a UV curable adhesive, and/or other adhesive. The adhesive may be partially and/or fully cured, which may ensure that the adhesive material stays in a desired location, without any need to worry about flash-off of the adhesive. At operation 404, a release liner may be removed from the adhesive material to expose a top surface of the adhesive material. The release liner may be similar to those described above. In some embodiments, the release liner may be biodegradable and/or may include a UV protective material. In some embodiments, prior to removing the release liner, pressure may be applied to the top surface of the release liner and the adhesive material to help the adhesive material better adhere to the substrate. This may be particularly advantageous when the adhesive material includes a pressure sensitive adhesive, but may be done for any type of adhesive material. In some embodiments, the pressure may be applied by passing a weighted roller over the top surface of the release liner, with the weighted roller having a weight equivalent to at least 5 pounds per linear inch of roller.

Upon removing the release liner, a roofing membrane may be applied to the exposed top surface of the adhesive material to adhere the roofing membrane to the substrate at operation 406. For example, a roll of roofing membrane may be unrolled such that a bottom surface of the roofing membrane contacts the exposed top surface of the adhesive material. In some embodiments, once the roofing membrane has been applied, pressure may be applied to a top surface of the roofing membrane, which may help the roofing membrane to better adhere to the adhesive material and substrate. In some embodiments, the pressure may be applied by passing a weighted roller over the top surface of the release liner. In some embodiments, unrolling the adhesive material, removing the release liner, and/or applying the roofing membrane are performed using a roofing membrane installation apparatus as described in greater detail with respect to FIG. 5.

While described as a process for installing a roofing membrane to a roofing substrate, it will be appreciated that process 400 may be used to apply a membrane or other material to other surfaces. Additionally, process 400 is not limited to adhering materials to horizontal substrates. Rather, the use of a partially and/or fully cured adhesive roll may enable that adhesion of materials to vertical, angled, and/or curved surfaces, while still providing a consistently uniform amount of adhesive and tack across the surface area of the adhesive roll.

Figure 5:
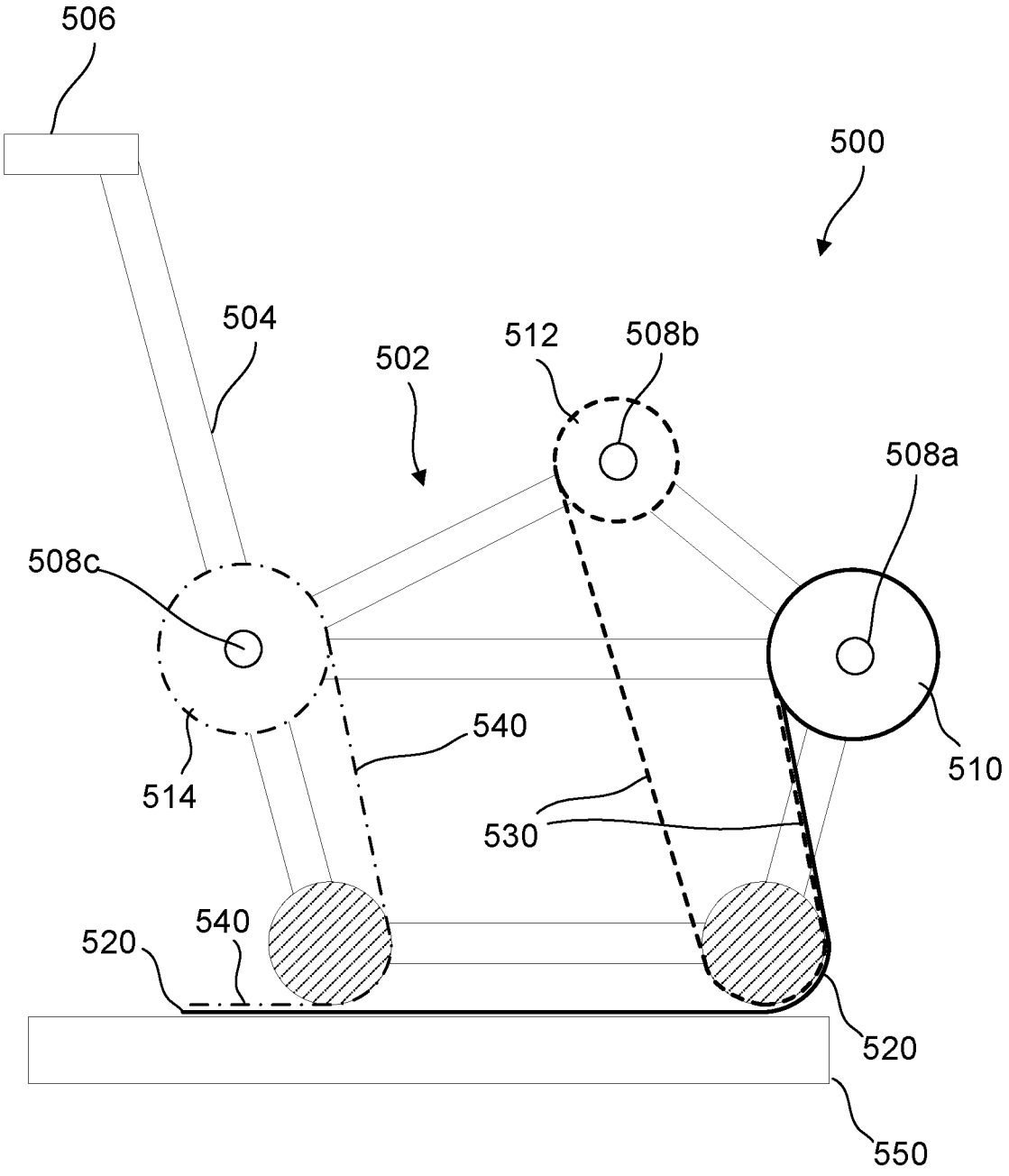
FIG. 5 illustrates a roofing membrane installation apparatus according to embodiments of the present invention.

FIG. 5 illustrates one embodiment of a roofing membrane installation apparatus 500. Roofing membrane installation apparatus 500 may be used to perform all or part of the process 400 described above. Roofing membrane installation apparatus 500 may include a frame 502, which may include a frame body 504 and at least one handle 506 extending from the frame body 504. The frame body 504 may include a number of mounting hubs 508 on which one or more spools and/or reels may be mounted. For example, an adhesive spool 510 may be rotatably coupled with the frame 502 using a mounting hub 508*a*. As illustrated, the adhesive spool 510 may be mounted on a forward portion of the frame body 504 in some embodiments. The adhesive spool 510 may include a roll of adhesive material 520, similar to those described herein. For example, the adhesive roll may include an adhesive material 520 that includes a release liner 530 on one side of the film. A release liner take-up reel 512 may be rotatably coupled with the frame 502 using a mounting hub 508*b*. The release liner take-up reel 512 may be used to collect the release liner 530 from the adhesive material 520 once the adhesive material 520 has been applied to a substrate 550. In some embodiments, the release linear take-up reel 512 may be positioned above and/or rearward of the adhesive spool 510. A roofing membrane spool 514 may be rotatably coupled with the frame 502 using a mounting hub 508*c*. The roofing membrane spool 514 may include a roll of roofing membrane 540, similar to those described herein. For example, the roofing membrane spool 514 may include a single-ply roofing membrane formed of TPO, PVC, EPDM, and/or other polymeric material.

In operation, an outer end of adhesive material 520 may be positioned against a substrate 550, such as a roofing substrate, and the frame 502 may be advanced by pushing the apparatus 500 using the handles 506. As the frame 502 is advanced, the adhesive material 520 is unwound from the adhesive spool 510 and is applied to the substrate 550, As the frame 502 moves forward, the release liner 530 may be peeled from the top surface of the adhesive material 520 and may be rolled up and/or otherwise collected on the release liner take-up reel 512. After the adhesive material 520 has been applied to the substrate, the roofing membrane 540 may be unwound from the roofing membrane spool 514 and applied to the exposed top surface of the adhesive material 520 as the frame 502 is advanced in the forward direction.

In some embodiments, the apparatus 500 may include a front weighted roller 516 that is positioned rearward of and below the adhesive spool 510 and forward of the release liner take-up reel 512. In operation, as the frame 502 is advanced, the front weighted roller 516 may roll over the top surface of the release liner 530 and adhesive material 520 to apply pressure to the release liner 530 and the adhesive material 520 prior to the release liner 230 being removed and collected by the release liner take-up reel 512. This enables the front weighted roller 516 to press the adhesive material 520 against the substrate to improve adhesion between the materials without the front weighted roller 516 contacting the adhesive material 520 itself. The apparatus 500 may include a rear weighted roller 518, which may be positioned rearward of and below the roofing membrane spool 514. In operation, as the frame 502 is advanced, the rear weighted roller 518 may roll over the top surface of the roofing membrane 540 to apply pressure to the roofing membrane 540 and the adhesive material 520. This enables the rear weighted roller 518 to press the roofing membrane 540 against the adhesive material 520 to improve adhesion between the materials. Each of the front weighted roller and the rear weighted roller may have a weight per linear inch of at least about 5 pounds per linear inch. In some embodiments, the weighted rollers may serve as wheels for the apparatus 500, while in other embodiments in addition to or in place of the rollers, one or more wheels are mounted on the frame 502 to facilitate movement of the apparatus 500.

It will be appreciated that the design of the apparatus 500 described above is merely representative of one example of an apparatus for installing a roofing membrane (or other rolled material). It will be appreciated that other spool/reel positions are possible, and that rollers and/or other devices may be included to change direction and/or otherwise redirect the material to or from a given spool/reel to a desired location.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. It will be further appreciated that all testing methods described here may be based on the testing standards in use at the time of filing or those developed after filing.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a"

and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A method for applying a roofing membrane, comprising:

unrolling an adhesive material onto a roofing board to adhere a bottom surface of the adhesive material to the roofing board, wherein the adhesive material comprises between about 50% and 90% by weight of a 100% cured acrylic high molecular weight hot melt adhesive, between 0% to 20% by weight of a rosin or terpene resin tackifier, and between 0% to 15% by weight of curatives;

removing a release liner from the adhesive material to expose a top surface of the adhesive material; and applying a roofing membrane to the exposed top surface of the adhesive material to adhere the roofing membrane to the roofing board.

2. The method for applying a roofing membrane of claim 1, wherein:

applying the roofing membrane comprises unrolling the roofing membrane onto the exposed top surface of the adhesive material.

3. The method for applying a roofing membrane of claim 1, further comprising:

applying pressure to a top surface of the roofing membrane once applied to the top surface of the adhesive material.

4. The method for applying a roofing membrane of claim 3, wherein:

applying pressure to the top surface of the roofing membrane comprises rolling the roofing membrane with a weighted roller.

5. The method for applying a roofing membrane of claim 1, wherein:

unrolling the adhesive material, removing the release liner, and applying the roofing membrane are performed using a roofing membrane installation apparatus.

6. The method for applying a roofing membrane of claim 1, wherein:

the release liner comprises a UV protective material.

7. A roofing kit, comprising:

a roll of adhesive material, wherein an outer surface of the adhesive material comprises a release liner, wherein:

the adhesive material comprises between about 50% and 90% by weight of a 100% cured acrylic high molecular weight hot melt adhesive, between 0% to 20% by weight of a rosin or terpene resin tackifier, and between 0% to 15% by weight of curatives;

the adhesive material has a thickness of between about 1 mil to 100 mils; and the release liner has a thickness of between about 1 mil and 15 mils; and a roll of roofing membrane, wherein the roofing membrane comprises one or more of TPO, EPDM, and PVC.

8. The roofing kit of claim 7, wherein:

the adhesive comprises one or more selected from a group consisting of a hot melt adhesive, water-based adhesive, a pressure sensitive adhesive, a butyl rubber-based adhesive, and a UV curable adhesive.

9. The roofing kit of claim 7, wherein:

the release liner is biodegradable.

10. The roofing kit of claim 7, wherein:

the release liner comprises a UV protective material.

11. The roofing kit of claim 7, wherein:

a thickness of the adhesive material is uniform to within 95% across a surface of the adhesive material.

12. The roofing kit of claim 7, wherein:

the adhesive material is at least partially cured.

13. The method for applying a roofing membrane of claim 1, wherein:

a molecular weight of the resin is between 100,000 MV/g/mol and 600,000 MV/g/mol.

* * * * *